US007316237B2

(12) United States Patent
Connelly

(10) Patent No.: US 7,316,237 B2
(45) Date of Patent: Jan. 8, 2008

(54) CHILDREN'S PLAY AREA SUNSHADE CANOPY

(75) Inventor: Kevin Connelly, Sarasota, FL (US)

(73) Assignee: Solar Dynamics Corporation, Wilmington, DE (US)

( * ) Notice: Subject to any disclaimer, the term of this patent is extended or adjusted under 35 U.S.C. 154(b) by 0 days.

(21) Appl. No.: 11/412,681

(22) Filed: Apr. 27, 2006

(65) Prior Publication Data

US 2006/0191564 A1 Aug. 31, 2006

Related U.S. Application Data

(63) Continuation of application No. 10/679,469, filed on Oct. 7, 2003, now abandoned, and a continuation of application No. 10/429,403, filed on May 6, 2003, now abandoned, which is a continuation-in-part of application No. 09/960,483, filed on Sep. 24, 2001, now Pat. No. 6,651,685.

(51) Int. Cl.
*E04H 15/58* (2006.01)

(52) U.S. Cl. ..... 135/117; 135/119

(58) Field of Classification Search ..... 135/98, 135/114, 117, 120.3, 900, 908, 902, 909; 52/653.2, 93.1, 93.2, 73, 90.1, 74–78; 248/127, 248/441.1, 159, 188.1; 403/169, 178, 286, 403/292; 472/116, 117; 482/35, 36
See application file for complete search history.

(56) References Cited

U.S. PATENT DOCUMENTS 552,533 A * 1/1896 Leonard ..... 52/93.2
589,563 A 9/1897 Jensen
773,831 A * 11/1904 Di Vito ..... 52/648.1
1,258,408 A * 3/1918 Hill ..... 52/93.2
1,878,758 A 9/1932 Clayton
1,900,274 A 3/1933 Brockie
2,015,321 A 9/1935 Shelton
2,530,765 A * 11/1950 Greenup ..... 135/98
2,928,404 A * 3/1960 Klages ..... 135/98
3,095,069 A * 6/1963 Winkler ..... 135/123
3,303,851 A * 2/1967 Grunfeld ..... 135/155
5,331,992 A 7/1994 Gremont
5,335,685 A * 8/1994 Dahulich ..... 135/156
5,496,232 A * 3/1996 Morris et al. ..... 482/35
5,528,875 A * 6/1996 Ziegler et al. ..... 52/702
5,660,005 A * 8/1997 Tacoma ..... 52/93.2
5,662,525 A 9/1997 Briggs
6,165,106 A 12/2000 McBride et al.

(Continued)

FOREIGN PATENT DOCUMENTS

JP 03137342 A * 6/1991

*Primary Examiner*—Janet M. Wilkens
*Assistant Examiner*—Timothy M Ayres
(74) *Attorney, Agent, or Firm*—Christopher Paradies; Fowler White Boggs Banker P.A.

(57) ABSTRACT

A demountable wind-resistant sunshade canopy for shading children's play areas or other actively used areas. The canopy device is removably secured over a support structure, and is comprised of a hip beams supported by columns mounted on the support structure, and the hip beams extend upwardly and inwardly toward an apex or ridge beam. Cantilevered ends of the hip beam extend beyond the support structure, providing shade for equipment, such as children's play equipment or other actively used areas.

17 Claims, 11 Drawing Sheets

U.S. PATENT DOCUMENTS 6,200,060 B1 3/2001 Vernay
6,874,518 B2 * 4/2005 Porter ..... 135/124
2003/0009955 A1 * 1/2003 Sellers ..... 52/90.1
2004/0060588 A1 * 4/2004 Lekhtman ..... 135/98

* cited by examiner

FIG. 5
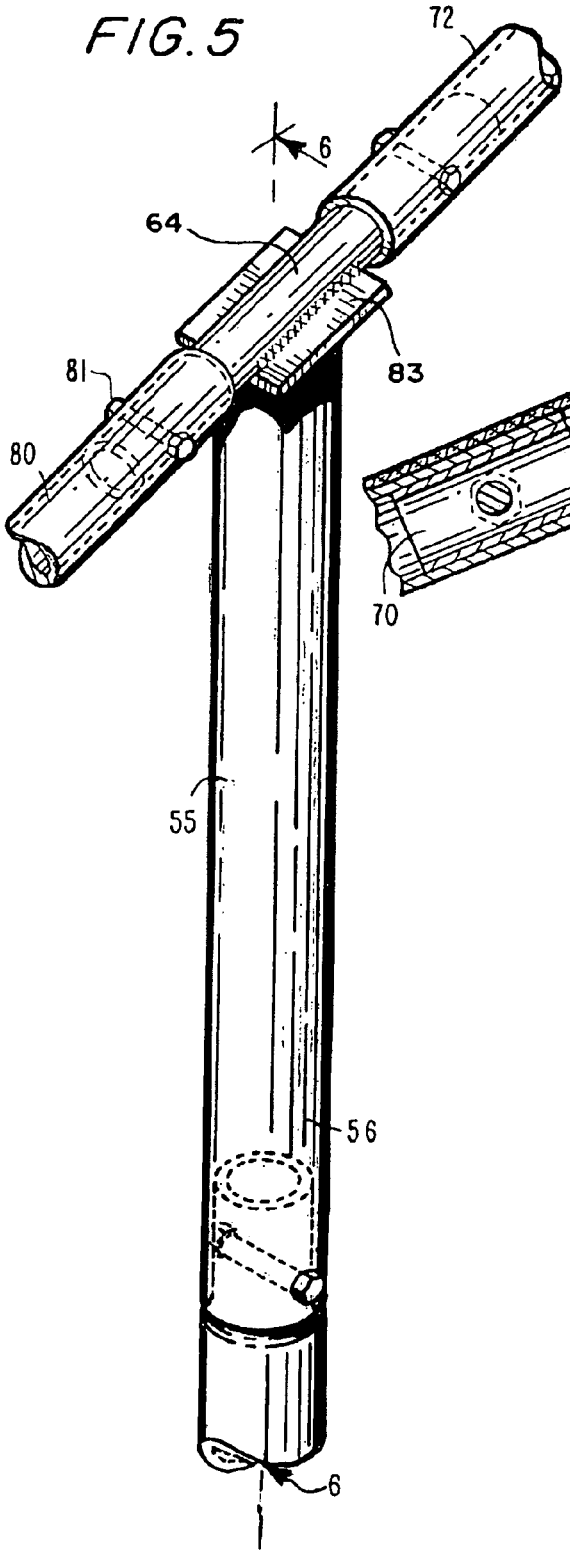
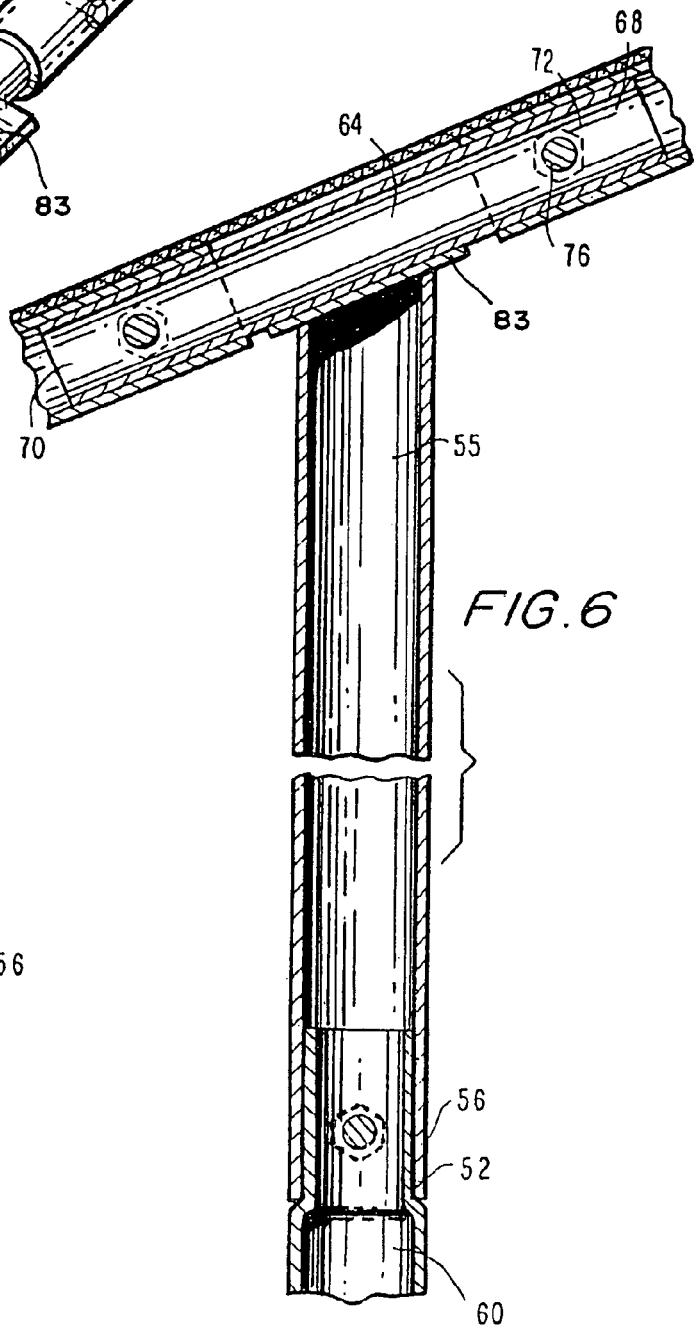
FIG. 6

FIG. 9
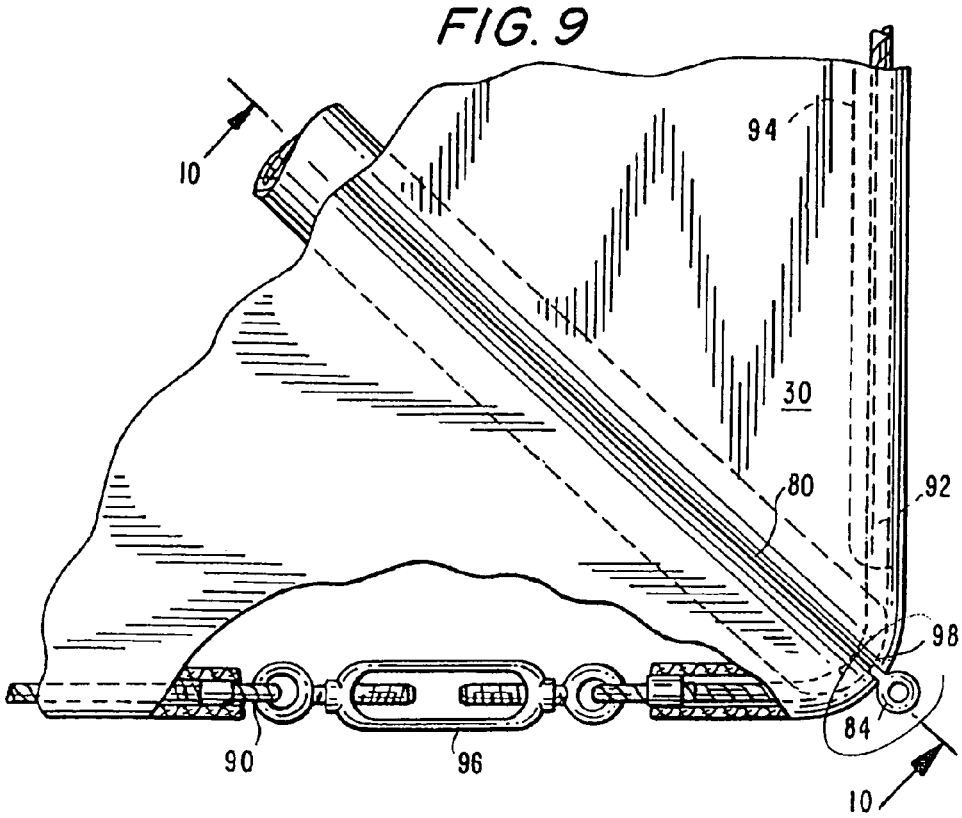
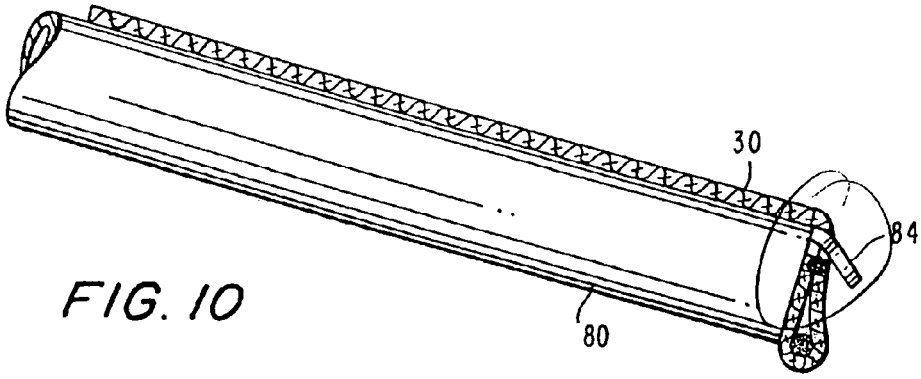
FIG. 10

CHILDREN'S PLAY AREA SUNSHADE CANOPY

RELATED U.S. APPLICATION DATA

This application is a Continuation of application Ser. No. 10/429,403 filed on May 6, 2003 now abandoned and a Continuation of application Ser. No. 10/679,469, filed on Oct. 7, 2003 now abandoned, which is a Continuation In Part of application Ser. No. 09/960,483 filed on Sep. 24, 2001, now U.S. Pat. No. 6,651,685, each of the descriptions and drawings of application Ser. Nos. 10/429,403 and 10/679,469 being incorporated by reference herein.

BACKGROUND OF THE INVENTION

This invention at hand relates generally to a demountable sunshade canopy structure and in particular to sunshade canopies for ultraviolet UV sun ray protection of children's play areas.

It is increasingly acknowledged that physically challenging outdoor play structures are of a benefit to the physical and emotional development of young children. A code of safety specifications for the construction and maintenance of children's play structures has been developed by National Play and Playground Authorities, published (1996) by the National Recreation and Park Association of Arlington Va. These construction specifications describe construction features for support of children's slides, swings, climbing apparatus, etc. which minimize risk of injury to children engaged in all manner of predictable use or misuse of the play structures.

The specification requires that the play structures be mounted on a platform or on towers elevated up to six feet above a resilient (non-hardened) surface such as cork or rubber panels and the towers or the platform be supported by a very limited number of support columns. The columns are to be capped at the top without exterior fittings on which a child may be injured while climbing upon or falling from the platform or tower. The support columns are capped at the top to discourage a child from climbing or holding on while suspended from the column top. The vertical support columns have been in the past a source of injuries to children engaged in unintended use of these structures. Accordingly, the minimum of vertical columns, all free of hand-or foot holds, has become a specification for an acceptable and safe design.

Separate from the safe construction design referred to above which have and are significantly reduce playground injuries, there is a growing threat to children's health when they are engaged in outdoor play and or exercise in the sun shine.

There are numerous publications that exhibit various canopies over play areas and covers over other areas as follows:

U.S. Pat. No. 589,563 to Jensen shows a canopy to act as a tent. It is so designed that it is collapsible and has movable joints and brackets for the purpose.

U.S. Pat. No. 1,878,758 to Clayton shows a cover a mery-go-around having cover extensions that extend past the perimeter of the platform. The merry-go-around as propelled by children that are standing on the platform and hanging on to hand rails. There are no play ground devices located on the platform.

U.S. Pat. No. 1,900,274 to Brockie illustrates a collapsible play pen having vertical support columns including brackets that support hip beams. There are no cantilevered beams to extend outwardly from the brackets supporting the hip beams.

U.S. Pat. No. 2,015,321 to Shelton discloses canopy including a frame. The frame has brackets that support the frame on vertical columns including beams that extend in a horizontal direction. Hip beams are deployed by operating a central hand crank screw drive. The hip beams do not extend from the brackets on the vertical supports.

U.S. Pat. No. 5,331,992 to Gremont shows a canopy structure that employs rigid bracket to support hip beams but no cantilevered beams are disclosed.

U.S. Pat. No. 5,662,525 to Briggs discloses an elevated platform having a canopy placed there over but children's play devices are placed at a remote location.

U.S. Pat. No. 6,165,106 to McBride illustrates an elevated platform with children's play devices attached to the platform but there is no teaching that play devices may be placed on and in contact with elevated platform.

U.S. Pat. No. 6,200,060 describes a dome tent pole connector wherein the bracket my collapsibly support dome shaped hip beams.

The earth's protective atmosphere ozone layer has significantly been depleted due to release of chemical pollutants into the atmosphere during the last five decades. The result of the ozone depletion is that the solar ultraviolet UV rays are significantly more intense and comprise a serious health risk to children when playing in the now unfiltered UV sun radiation. In 1930 the risk of developing melanoma form sun exposure was 1 in 1500. Today, a person's risk of developing skin cancer at some time during their life is 1 in 75. Skin cancer is the most common cancer in the United States each year with more than one million cases diagnosed each year. Currently, this year, 47,700 Americans will be diagnosed with life threatening melanoma and 7,700 will die of this disease. The current prognosis for this disease is that approximately one out of five children in the United States will experience some form of skin cancer during their lifetime. Furthermore, exposure to the current intensity of solar UV radiation reduces the effectiveness of the immune system. This effect is of special importance to children's health.

Sources of the above statistics can be found in publications of the American Academy of dermatology, American Cancer Society, National Institutes Health, US Center for disease Control and the Australian Cancer Society.

The copending application Ser. No. 09/960,483 goes into detail how to construct a shaded canopy over a children's playground or exercise area which is incorporated herein by reference. Of particular interest are the connections of the cantilevered beams and the angled hip beams that are made to conform to the vertical support columns. These connections are simplified by constructing certain fittings that will greatly simplify those connections in a standard and more precise way and at a much lower cost.

BRIEF SUMMARY OF THE INVENTION

A demountable wind resistant sun shade canopy is suitable for mounting on playground equipment. The canopy support structure includes a plurality of fittings. The bracket fittings may be of a unitary and rigid construction. One example is the use of transverse rod connectors. The fittings, when each is fixedly mounted, provide for attachment to columns extending upwardly from children's play equipment. A cantilever beam extend outwardly from the fittings toward the perimeter of the play area to be shaded. A hip beam extending upwardly at an angle and is coupled to other hip beams and/or a ridge beam, providing a structure extending toward the inner portion of the area to be shaded. Thus, an extended-area to be shaded includes a rigid support structure which is provided over a designated area which may be dependably shaded from the sun's rays when a fabric canopy, such as a high density knitted polyethylene porous canopy cover is placed over the unique bracket fitting supporting a plurality of cantilever and hip beams support members and secured about the perimeter of the canopy cover, such as with an adjustable tension means. The hip beams may be combined by way of an apex fitting which is instrumental in forming an apex of at least four hip beams. One of the beams connected into the apex fitting may be a horizontal tube that extends toward another apex so that two distant apexes can be connected to each other to form a larger canopy to form a cover over a rectangular play area.

BRIEF DESCRIPTION OF THE DRAWINGS

FIG. 5 is a perspective view of a construction bracket or fitting for mounting cantilever and hip beam members to form a support structure for mounting the canopy cover;

FIG. 6 is a cross-section of the bracket or fitting shown in FIG. 5 taken along the plane 6-6;

FIG. 9 shows a detail of the means for fastening the cover to the support structure with adjustable tension means;

FIG. 10 shows an elevation of an extended end of the cantilever member showing means for securing the canopy cover;

DETAILED DESCRIPTION OF THE INVENTION

Figure 1:
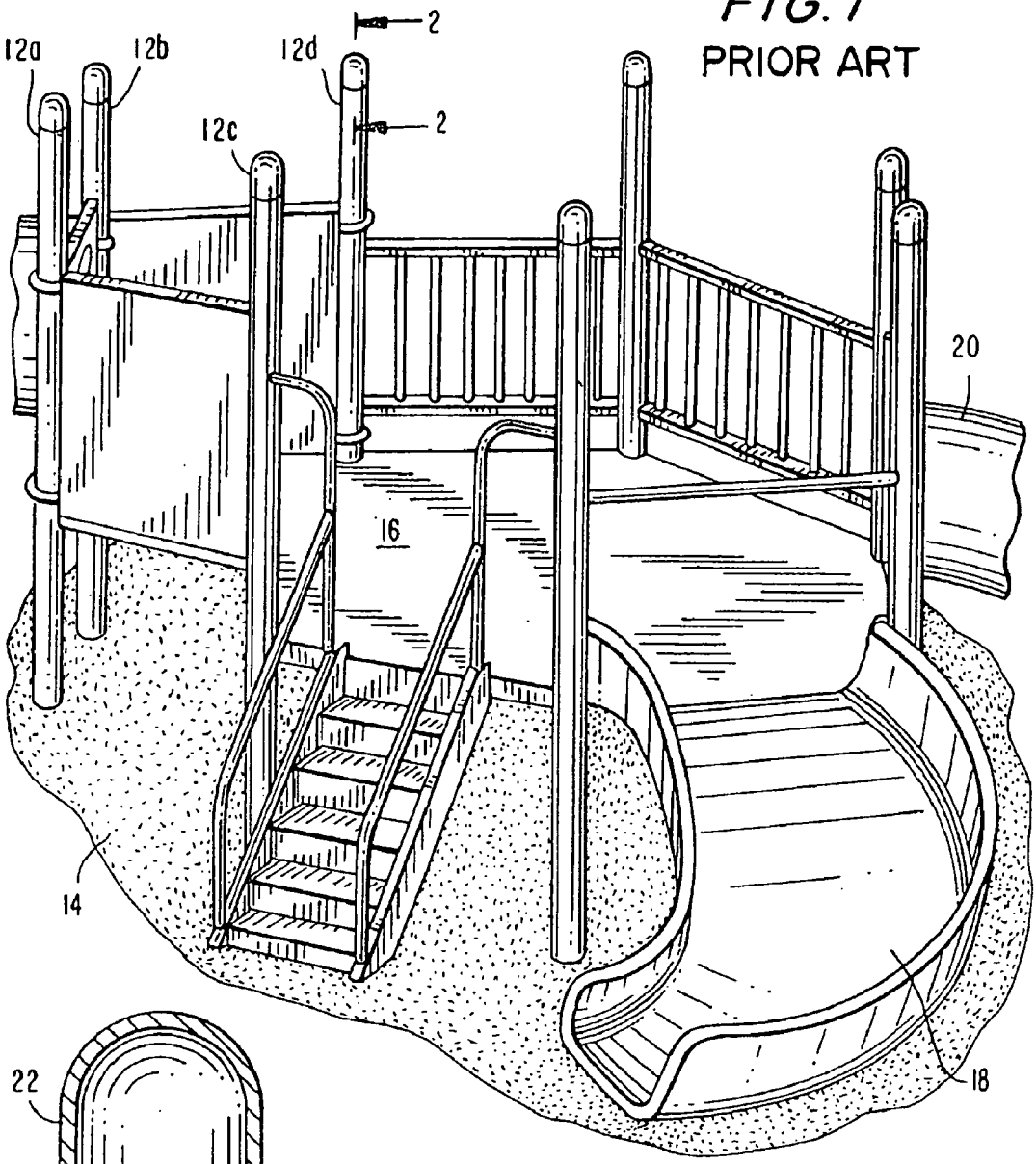
FIG. 1 PRIOR ART
FIG. 1 is a perspective view of a portion of an existing safe play structure without a sun protective canopy, the play structure is shown mounted above a resilient ground cover.

FIG. 1 illustrates a prior art safe design of a children's play structure wherein a plurality of fixedly mounted vertical support columns 12*a*, 12*b*, 12*c* and 12*d* are shown. The columns 12*a* and 12*b*, etc. are mounted in foundations (not shown) beneath a resilient ground cover 14. The ground cover may be made of rubber or cork or matted materials to soften an impact and reduce injuries to a child fallen thereon. The columns support a platform 16 from which a slide 18, a closed chute 20 and other children's climbing devices may be positioned.

Figure 2:
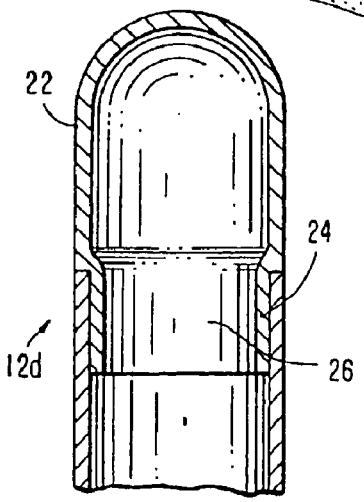
FIG. 2 PRIOR ART
FIG. 2 is cross-section through of the upper portion of the support of the prior art device of FIG. 1 taken along the plane 2-2.

The upper ends of the conventionally designed vertical columns 12*a*, 12*b*, 12*c* and 12*d* are shown in FIG. 2 in a cross-sectional plane 2-2. A column cap 22 fits over the top of column 12*d*. The cap 22 is shaped with a reduced diameter lower section 24 which, when inserted into the hollow opening 26 of the vertical column comprises a secure mount for the column cap 22. Although such conventionally designed columns are fully compatible with the invention, in order to avoid the possibility of rainwater leaking into the seam between the lower portion 24 and the column 12*d*, it is preferable to have the column designed as depicted in FIG. 6 where the upper end of the column 12*a* and 12*b* etc. has a smaller diameter than bracket 52 so that rainwater will flow over the juncture between the two tubes without entering the seam.

FIGS. 1 and 2 are illustrative of safe children's play structures in compliance with the safety specifications developed by the National Play and Playground Authorities. At this date there are tens of thousands of such play structures erected and being erected in the United States without any provisions for effective sun shades for children using such structures.

Figure 3:
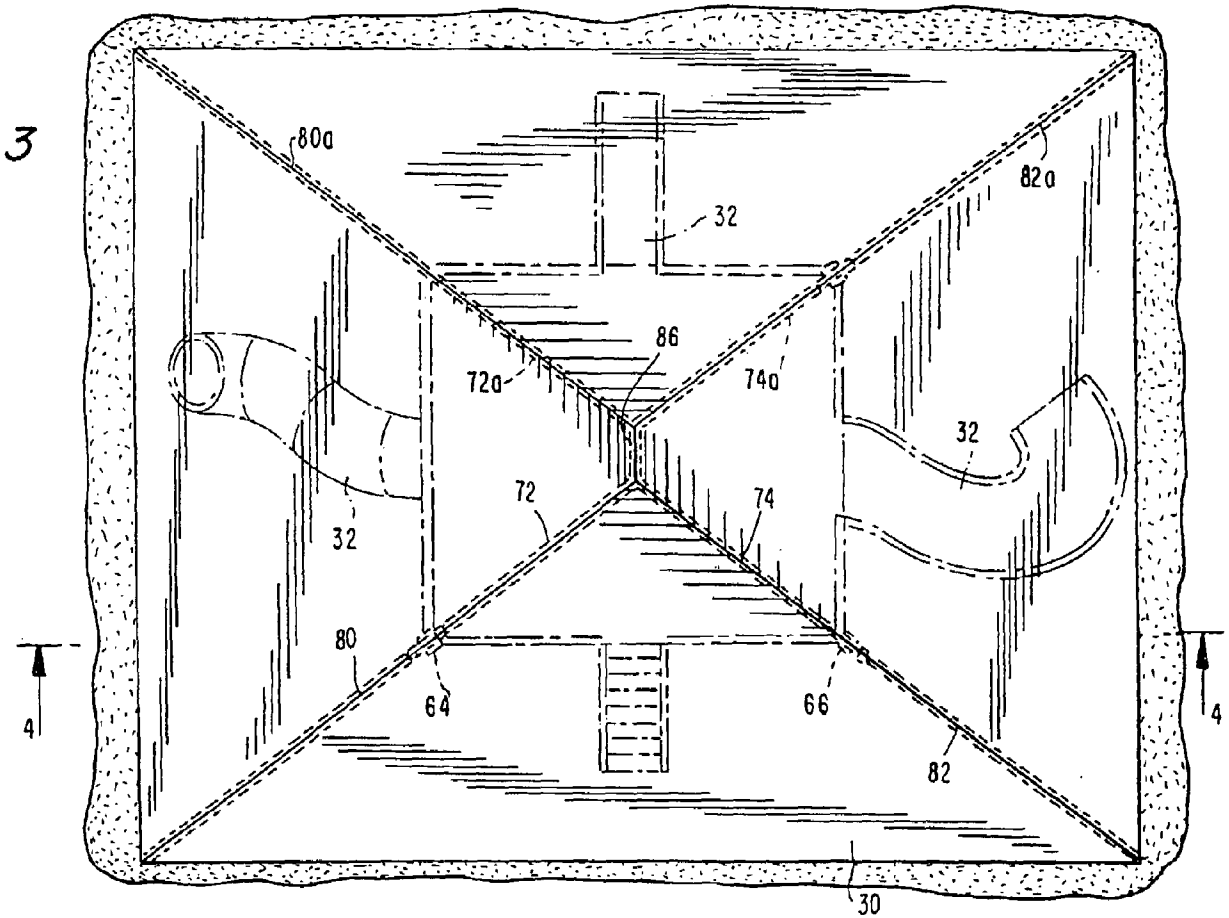
FIG. 3 is a plane view of a specified single tower children's play area on which the innovative sun shade canopy has been erected, the play exercise devices are shown in phantom lines. From this illustration it can be seen that the perimeter of the shaded area extends beyond the basic area of the play area perimeter.

A plan view of a first embodiment of this invention is shown in FIG. 3 wherein a canopy 30 is shown as being supported over structural members described below in subsequent Figs. which in turn are mounted above a children's exercise and play area with play devices shown in phantom lines below the canopy 30.

Figure 4:
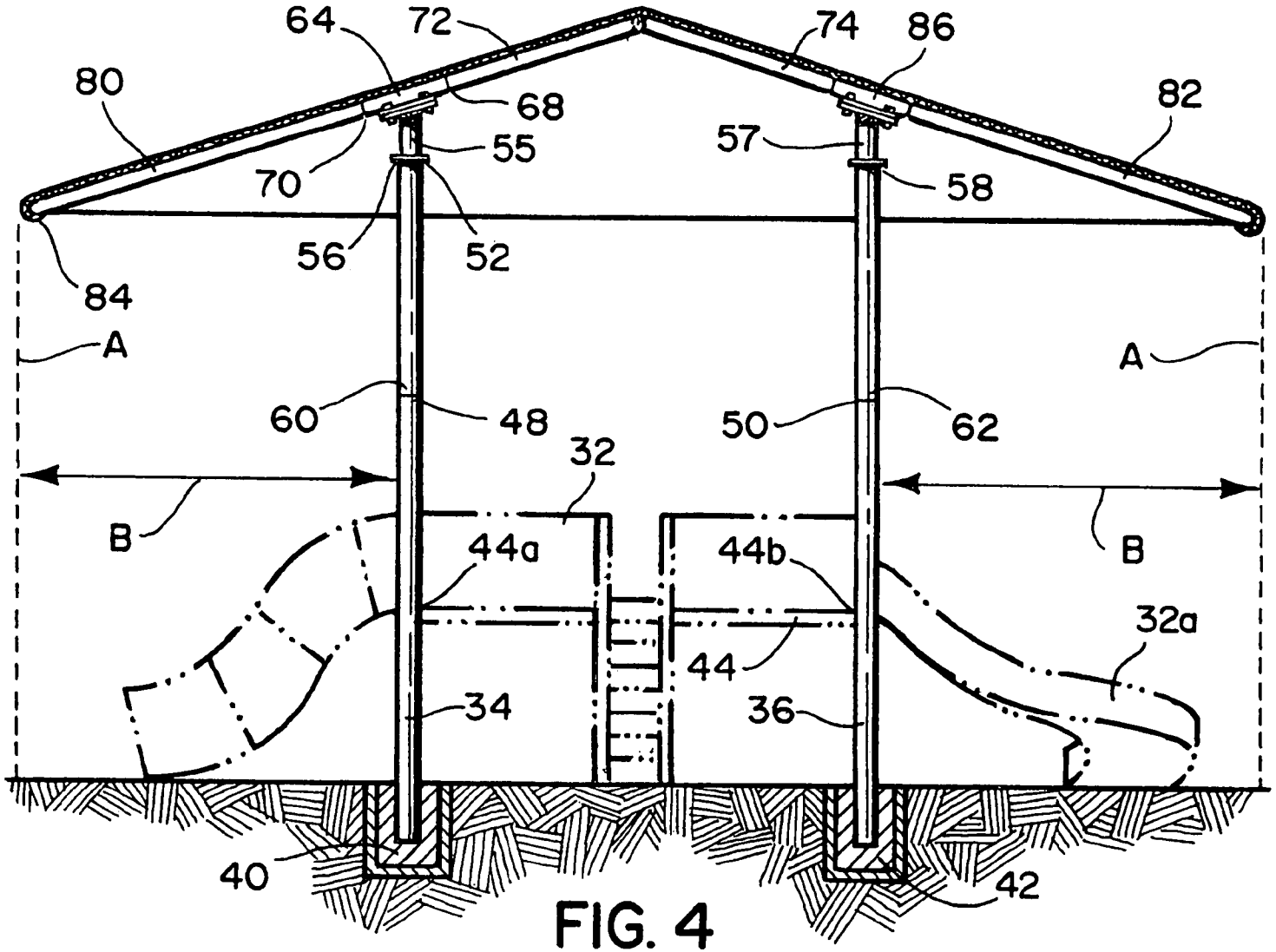
FIG. 4 is a sectional elevational view of the embodiment shown in FIG. 3 with portions of the play structures and canopy support members shown phantom.

FIG. 4 is a cross-sectional elevation of the embodiment shown in FIG. 3 in a plane 4-4. Vertical columns 34 and 36 are fixedly mounted, respectively, in concrete foundation footings 40 and 42. The vertical columns 34 and 36 constituting a plurality of first upright members support a platform or deck 44 at ends 44*a* and 44*b* fastened to the columns 34 and 36. The columns 34 and 36 terminate at approximately four feet above the platform or deck 44 the play devices 32 and 32*a* are either located on the surface and in contact with the platform or are dependent therefrom but are always within the perimeter of the shade canopy itself. The caps 22 such as shown in FIG. 2 have been removed from the upper ends of the columns 34 and 36 to expose the tops 48 and 50, respectively. A plurality of second upright members 60 and 62 are attached to the tops 48 and 50 of columns 34 and 36. At top ends of the second upright members there are provided transitional fittings 55 and 57 which are inserted into the tops of the second upright members. A detailed description will appear below with reference to FIGS. 13 and 14. The letter A illustrates a drop line from the outer perimeter of the canopy to the ground, while the letter B illustrates the distance between the outer or second perimeter of the canopy and the first perimeter of the play area.

FIGS. 5 and 6 are illustrative of the structural bracket fittings 55 and 57. More specifically, FIG. 5 depicts the bracket fitting 55 in a perspective cut-away and fragmentary view, while FIG. 6 is a view of the structural or transitional bracket 55 shown as a cross-section on plane 6-6.

In preferred embodiments, the lower portion 56 of the structural bracket fitting 55 fits over the reduced diameter upper end 52 of the upper column portion 60. In rainy weather, water will flow over the juncture of lower portion 56 and upper end 52 and will not enter the seam between the two elements where it might cause damage. The upper end of each the bracket fittings 55 and 57 is terminated with a transverse, angularly placed, cylindrical rod 64. The rod 64 is mounted at an acute angle with the vertical cylindrical extension or transitional fitting 55. The angle with the horizontal is normally 22 degrees but is subject to adjustments for specific applications. The rod 64 is part of the transverse rod connector. The rod 64 is transverse to the bracket fittings 55 and is a connector for the cantilever beams 80 and the hip beams 82 and the hip beams 72 and 74 (FIG. 4).

FIGS. 5 and 6 further show the mounting of the cylindrical rod 64 on a plate 83 which in turn is mounted at an angle from the horizontal to bracket fitting 55. The cylindrical rod 64 has an upper or first end 68 and a lower or second end 70. The hip beam 72 comprises a straight section of a hollow metal steel pipe or rod. The hip beam 72 is positioned over the upper or first end of 68 of the angularly mounted cylindrical rod 64 and is secured with threaded bolts 76 passing through the hip beam 72 and the cylindrical rod 64.

Figure 7:
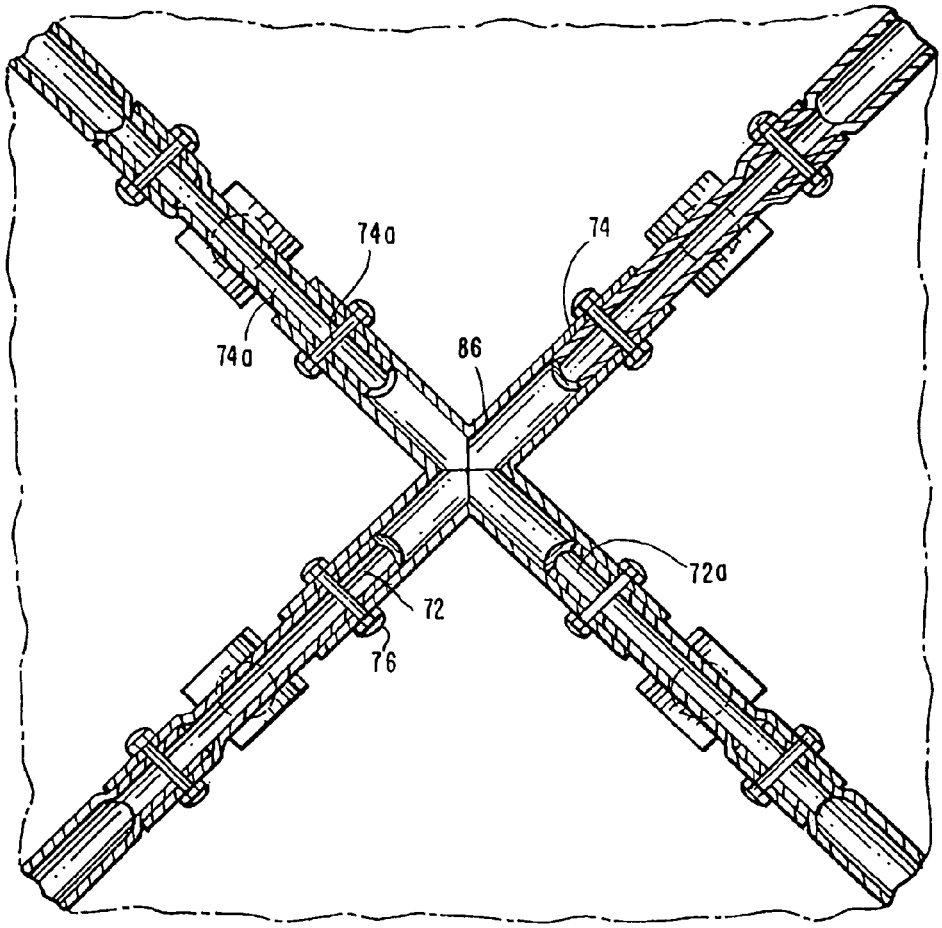
FIG. 7 is a plan view of the connector or fitting for a four hip beam canopy support construction shown in the embodiments of the sun shade canopy illustrated in FIGS. 3 and 4.
Figure 8:
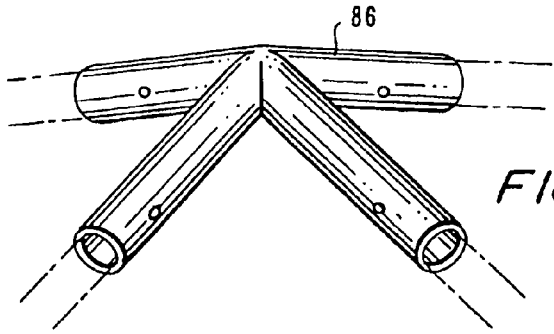
FIG. 8 is a perspective view of the hip beam connector fitting of FIG. 7.

The lower or second 70 end of the solid metal rod 64 is mounted by insertion into the upper end of the cantilevered beam 80 and is secured therein by threaded means 81. The cantilevered beam member 80 is comprised of a straight section of a hollow steel pipe or tube. The lower end of the cantilever beam is terminated with an oblong eyelet connector 84. As is shown in FIGS. 7 and 8, the four hip beams 72 and 74 and the counter parts 72*a* and 74*a* terminate in juxtaposition and are secured to each other by way of the right angle joint 86 to thereby form an apex fitting which is shown in FIG. 8.

Referring now back to FIG. 3, a porous knitted polyethylene canopy cover 30 is placed over the structure comprised of the hip beams 72, 72*a*, 74 and 74*a* and cantilever beams members 80, 80*a*, 82 and 82*a*. The canopy details are more clearly shown in FIG. 9. The canopy cover 30 is secured about its perimeter with a tension cable 90 which in turn is secured within a cable channel 92 sewn about the canopy perimeter 94. The tension on the cable is adjusted and maintained with a turn buckle 96. The canopy cover 30 is provided at its four corners with a reinforced opening 98 through which the oblong connector 84 located on the extreme end of the cantilevered beam 80 and its counterpart cantilever beam members 80 and its counterpart 82, etc., protrudes.

Figure 11:
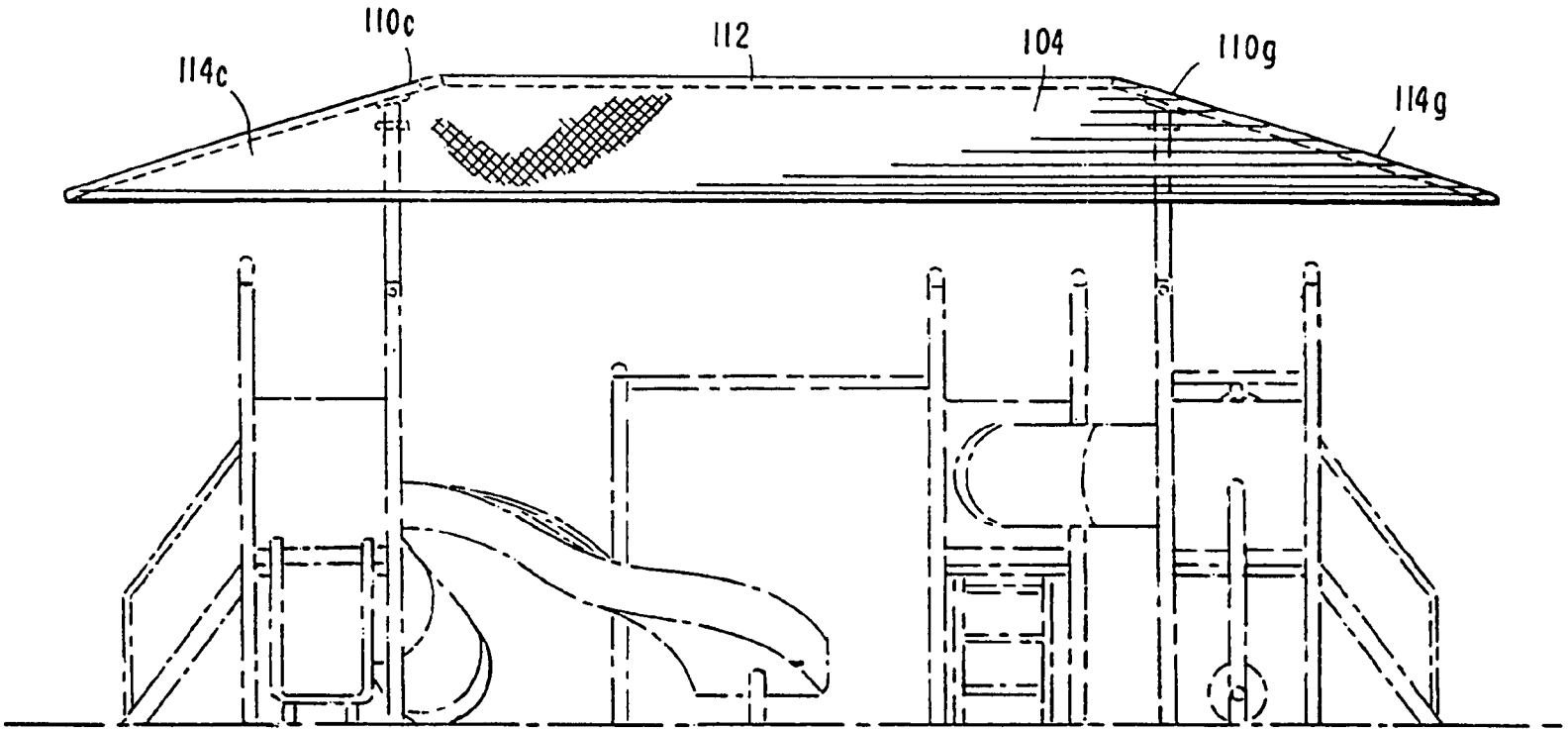
FIG. 11 is an elevational view of a second embodiment of the sun shade canopy structure mounted to cover a two tower specified safe children's play area.
Figure 12:
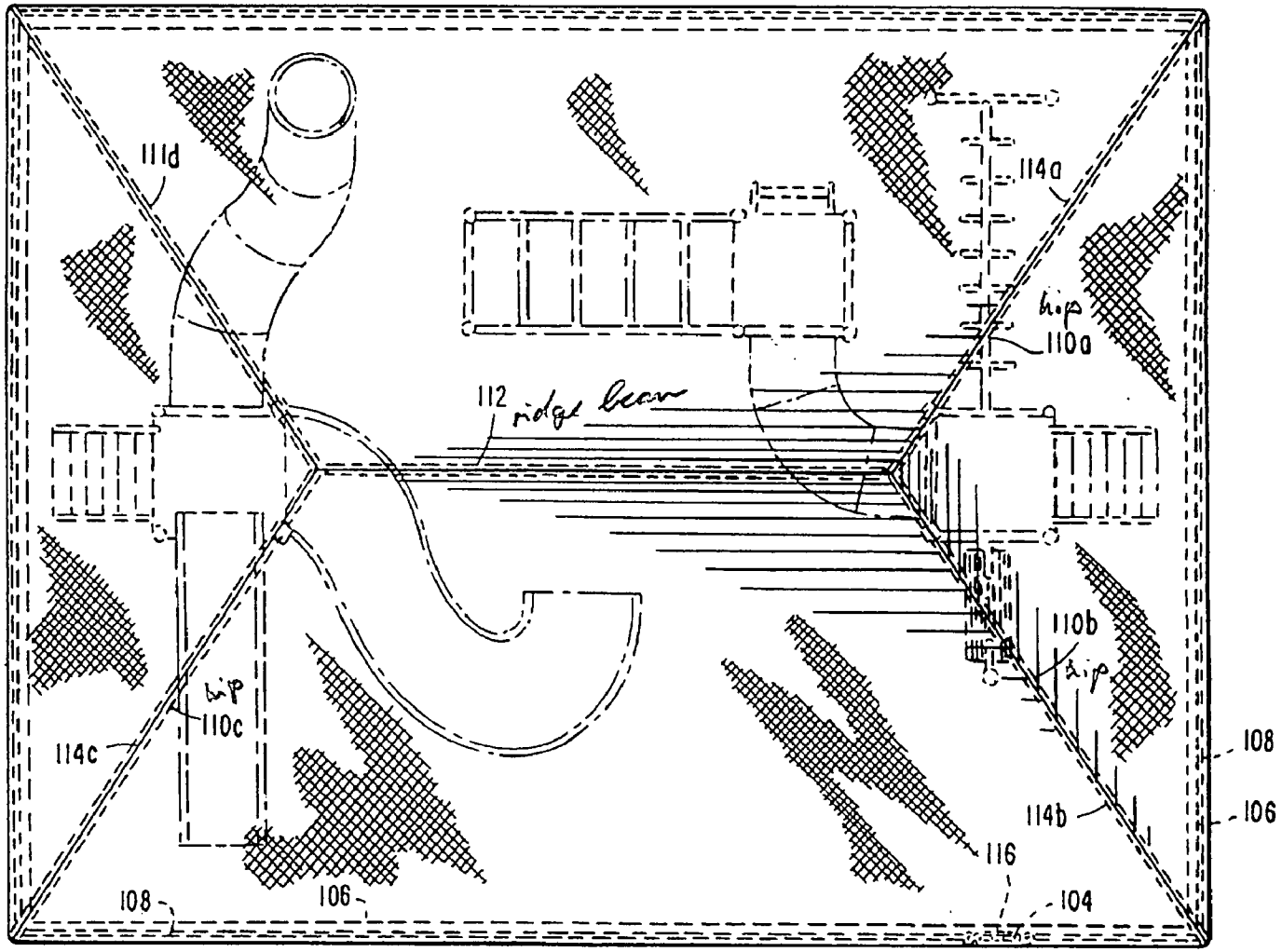
FIG. 12 is a plan view of the embodiment shown in FIG. 11 with the children's play area devices in phantom.

A second embodiment of this invention is illustrated in FIGS. 11 and 12 wherein a two tower' safe design children's play area is shown. The play and exercise devices are shown in phantom lines. A porous shade canopy cover 104 is fabricated from knitted polyethylene strips and is constructed similarly to the single tower canopy 30. The two tower canopy cover 104 is sewn so that it provides a cable channel 106. A tension cable 108 is threaded through the channel 106 and when positioned over the metal support structure of hip beams 110*a*, 110*b*, 110*c*, etc., forms a sunshade canopy. A turn buckle tension means 116 is attached to the ends of cable 108 to provide adjustments and to maintain cable tension.

The canopy cover 104 is provided at each corner with a reinforced opening 98 as is shown in FIG. 9 through which the oblong eyelet connector 84 on the cantilever beam member extends.

Figure 13:
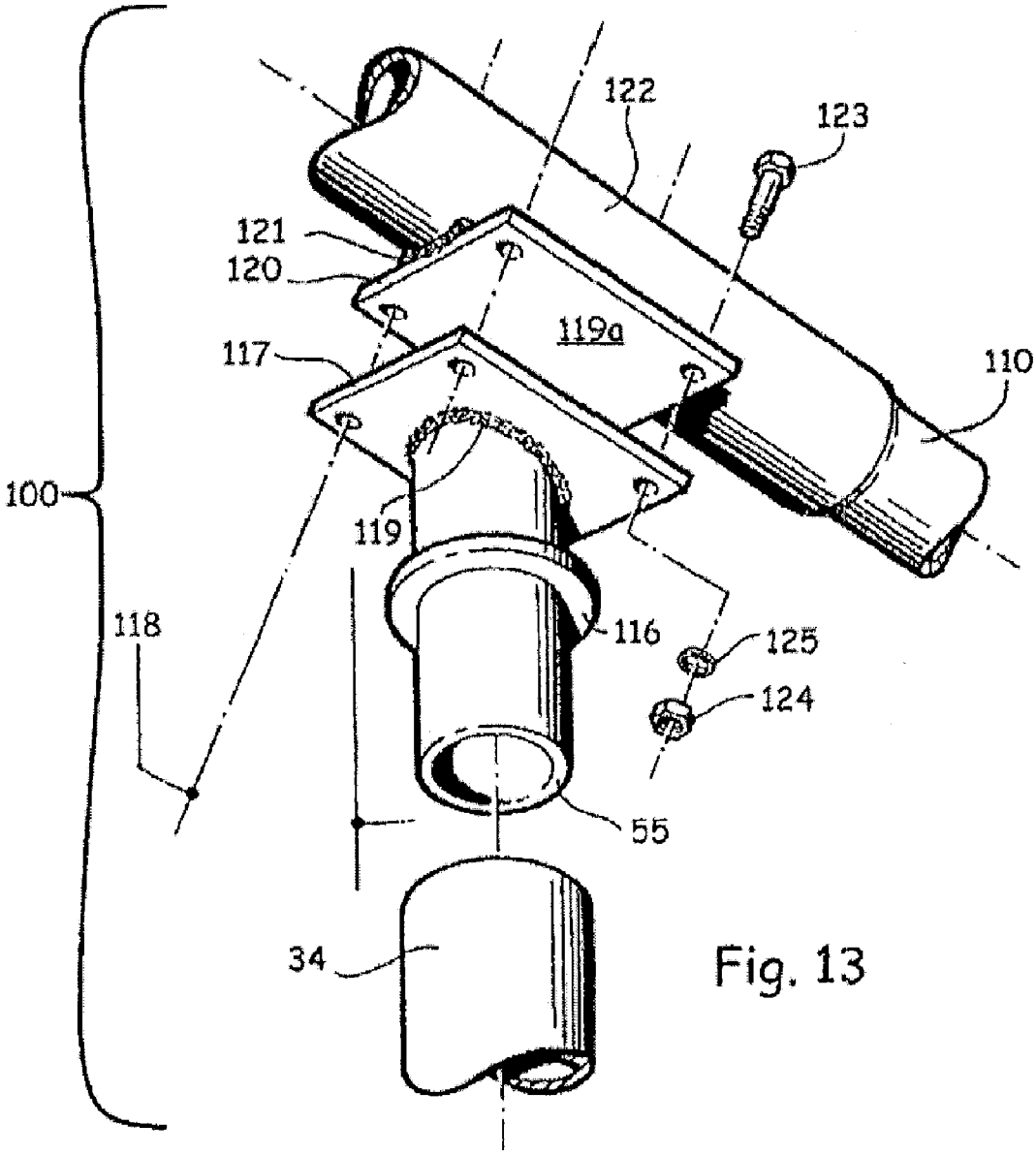
FIG. 13 is a perspective view of a connector fitting using connector plates to establish certain angles between the vertical support column and the hip beam member.

FIG. 13 illustrates a bracket fitting 100 to be used in erecting the structure that will support the sunshade canopy. This fitting is pre-assembled and will always include the correct angle of the slanted roof structure. The explanation will apply to one column only but it is applicable to all columns when the canopy structure is assembled. To this end, the fitting includes a lower insert pipe 115 which is of a reduced diameter when compared to the upstanding vertical columns 34, 36 (FIG. 4). Therefore, when installing structure for the canopy 30 or 104, the fitting is merely slipped into the opening of vertical columns 34 and 36 with its lower insert pipe 55 and 57 (FIG. 4). With other words, it is an interfitting concept. The lower insert pipe 55 or 56 has a limiting ring 116 which limits the extent of the insert pipes 55 or 57 into either of the vertical columns 34 or 56. Since the slant of the roof of the canopy is predetermined, a connector plate 119 is attached to the top of the insert pipe 55 by way of a welding 117. The predetermined angle is shown at 118. Since all the angles and distances are predetermined in the bracket fitting 100 includes a counter plate 120 which is welded to a saddle pipe 122 at 121. The saddle pipe 122 has an outer diameter that matches the outer diameter of the cantilever pipes 80 and 82 (FIG. 4) and the outer diameter of hip beams 72 and 74 (FIG. 4).

In other words, there is a smooth transition between the saddle pipe and the cantilever pipes or beams when connected to each other. Therefore, the cantilever beam and the hip beam have a diameter reduced at the point of insertion into the saddle pipe. Once the connector plate 119 and the counter plate 120 are aligned with each other, the bolts 123 are passed through both of the plates 119 and 120 which will connect the two plates 119 and 120 by way of the bolts and the nuts 124 and the lock washers 125.

Figure 14:
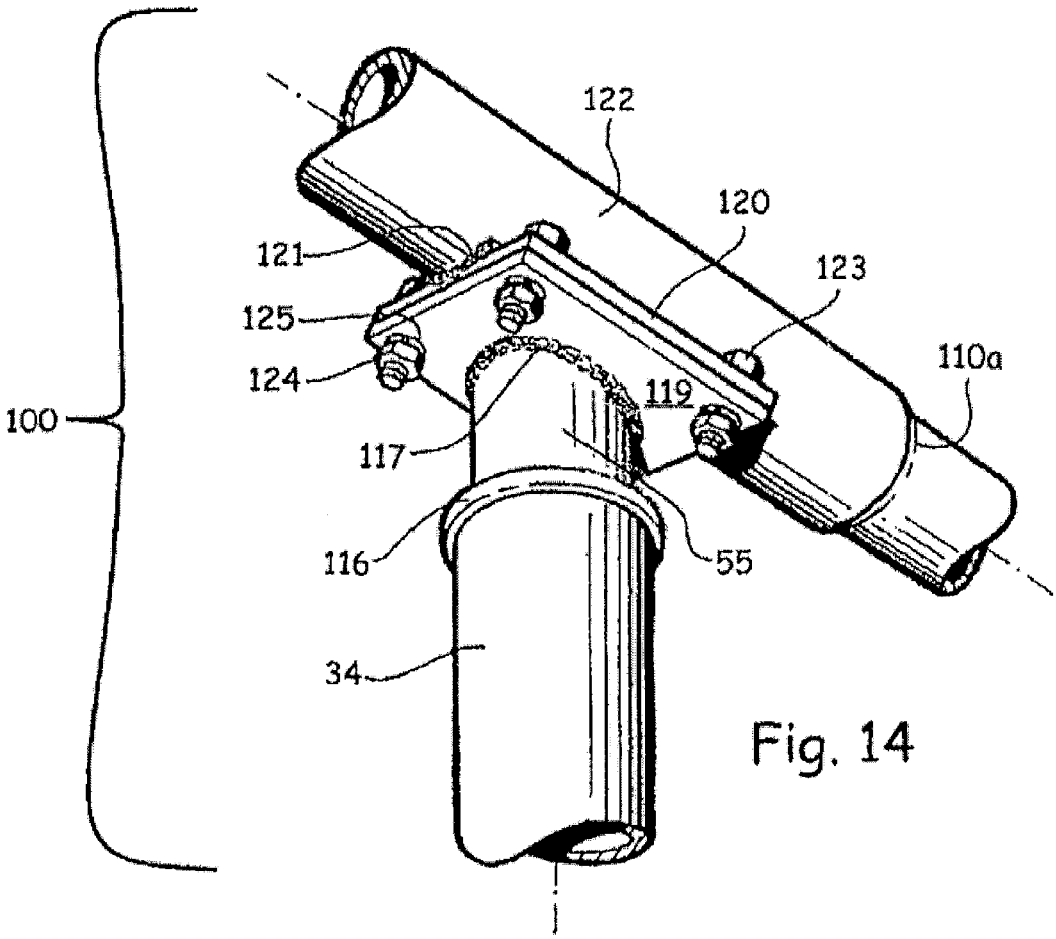
FIG. 14 is a perspective view of the connector plates of FIG. 13 connected together.

FIG. 14 shows the assembled bracket or fitting 100 in combination with the upstanding vertical columns 60 and 62 (FIG. 4) or 34 and the saddle pipe 122. The reference character 110*a* indicates a reduced diameter of the cantilevered pipe 110. This way the cantilevered pipe or beam 110 can easily slip into the pipe of the saddle pipe 122.

Figure 15:
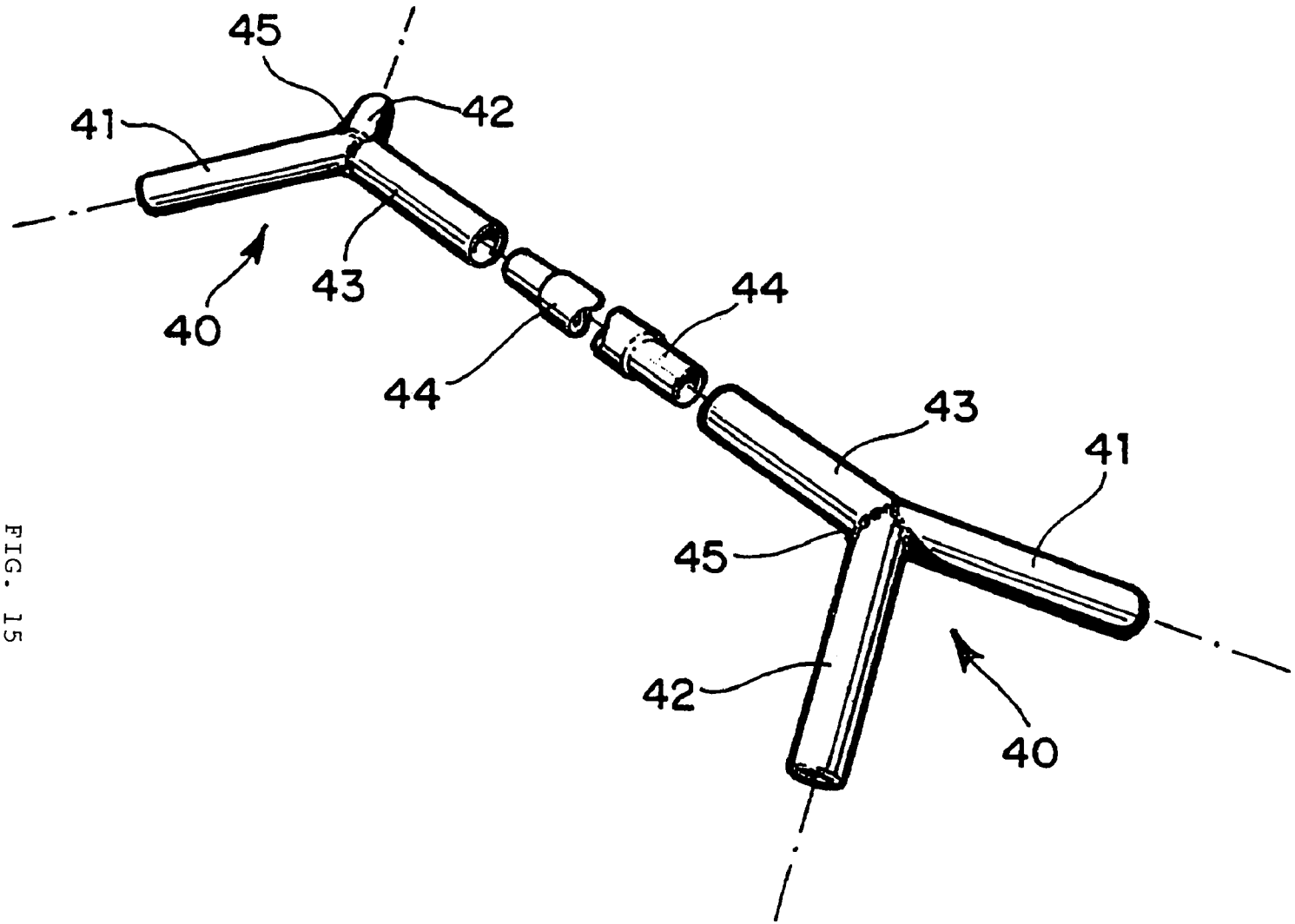
FIG. 15 is a perspective view of two apex fittings being connected by a root ridge beam.

FIG. 15 shows a construction wherein at least two apexes 140 are combined with each other. In this construction there are at least two hip beams 141 and 142, being the equivalents of hip beams 72 and 74 of FIG. 4, are connected to each other including one horizontal beam or tube 143 that will receive a horizontal connector beam or tube 144 so that the distant apexes 140 can be pre-constructed and can be delivered to the construction site for assembly.

What is claimed is:

1. A children's play structure, comprising:

a plurality of columns, each of the plurality of columns having a first end fixed in a footing and a second end opposite of the first end and extending upwardly;

a deck having an outer perimeter, the deck being supported above the footing of each of the plurality of columns, the second end of at least a plurality of the plurality of columns extending above the deck to a second end height;

a plurality of play components supported by the deck, one of the plurality of columns or both of the deck and one of the plurality of columns, and each of the plurality of play components extending outwardly from the outer perimeter of the deck and to the ground, defining a periphery of the plurality of play components; and a canopy support structure, comprising:

a plurality of cantilevered hip beams, each of the plurality of cantilevered hip beams comprising a cantilevered end member joined to a hip beam member by a transition fitting member, the transition fitting member being coupled to one of the second ends of the plurality of columns extending above the deck, such that the cantilevered end member extends outwardly from the outer perimeter of the deck in a downward angle to a horizontal plane, and the hip beam member extends inwardly from the outer perimeter of the deck in an upward angle to the horizontal plane, each of the plurality of cantilevered hip beams being coupled one to the other by a coupling member such that a canopy support structure is formed; a fabric canopy having a peripheral edge, the fabric canopy being retained on the canopy support structure using a cable and at least one tensioning device joining one end of the cable to another end of the cable such that the tensioning device adjustably applies tension to the cable;

wherein the peripheral edge of the fabric canopy extends outwardly at least to a distance above the periphery of the plurality of play components and the peripheral edge of the fabric canopy does not extend downwardly below the second end height of the plurality of columns extending above the deck.

2. The structure of claim 1, further comprising:

a plurality of upright members, each of the plurality of upright members having a length and coupling one of the plurality of transition fitting members to one of the second ends of the plurality of columns extending above the deck, wherein the length of each of the plurality of upright members is greater than a downward distance between the peripheral edge of the fabric canopy and each of the plurality of transition fitting members.

3. The structure of claim 2, wherein the downward angle to the horizontal is 22 degrees.

4. The structure of claim 1, wherein the coupling member is a first apex fitting.

5. The structure of claim 4, wherein the first apex fitting couples two of the plurality of cantilevered hip beams to a ridge beam.

6. The structure of claim 5, wherein the ridge beam is coupled to a second apex fitting.

7. The structure of claim 6, further comprising a second deck and two additional columns supporting two additional cantilevered hip beams coupled to the second apex fitting, such that the peripheral edge of the fabric canopy extends beyond a perimeter of the second deck.

8. The structure of claim 1, wherein the coupling member is an apex fitting having four extending members joined at an apex and each of the four extending members is joined to one of the four cantilevered hip beams supported by four second ends of four columns extending above the deck.

9. The structure of claim 2, wherein at least one weldment joins each of the plurality of cantilevered hip beams to one of the plurality of upright members.

10. The structure of claim 1, wherein the tensioning device is a turn buckle.

11. The structure of claim 1, wherein each of the plurality of transition fitting members comprises:

a tube having a first end and a second end, the first end being detachably coupled to one of the plurality of cantilevered end members and the second end being detachably coupled to one of the plurality of hip beam members; and an upright member coupled at one end to the tube and at the other end to one of the second ends of the plurality of columns extending above the deck.

12. The structure of claim 11, wherein the upright member is coupled at one end to the tube by at least one weldment.

13. The structure of claim 12, wherein the at least one weldment includes two weldments.

14. The structure of claim 13, wherein the two weldments including a first weldment between the tube and a first plate and a second weldment between the upright member and a second plate, and the first plate and the second plate are detachably coupled one to the other.

15. The structure of claim 12, wherein the at least one weldment including a weldment between the tube and a plate joined to the upright member.

16. The structure of claim 1, wherein the canopy support structure including no bracing and no trusses.

17. The structure of claim 1, wherein each of the second ends of the plurality of columns extending above the deck are disposed at the outer perimeter of the deck.

* * * * *